US006276414B1

(12) United States Patent
Bibb

(10) Patent No.: US 6,276,414 B1
(45) Date of Patent: Aug. 21, 2001

(54) MONEY TRAP WALLET

(76) Inventor: Marion Keith Bibb, 27 Canistes Trail, Bracey, VA (US) 23919

( * ) Notice: Subject to any disclaimer, the term of this patent is extended or adjusted under 35 U.S.C. 154(b) by 0 days.

(21) Appl. No.: 09/569,012

(22) Filed: May 11, 2000

Related U.S. Application Data

(60) Provisional application No. 60/138,265, filed on Jun. 9, 1999.

(51) Int. Cl.[7] ..... A45C 1/06
(52) U.S. Cl. ..... 150/132; 150/131
(58) Field of Search ..... 150/112, 131–133, 150/141, 143; 206/147, 148

(56) References Cited

U.S. PATENT DOCUMENTS

| | | | | |
|---|---|---|---|---|
| 739,754 | * | 9/1903 | Lovece | 150/133 |
| 1,269,247 | * | 6/1918 | Aslin | 150/132 |
| 1,326,602 | * | 12/1919 | McKey | 150/132 |
| 1,580,346 | * | 4/1926 | Sutter | 150/132 |
| 1,833,881 | * | 11/1931 | Hughes | 150/132 |
| 1,973,420 | * | 9/1934 | Trussell | 150/132 |
| 2,550,437 | * | 4/1951 | Yates | 150/132 X |
| 4,010,787 | * | 3/1977 | Traugott et al. | 150/132 |
| 4,940,068 | * | 7/1990 | Pokorny et al. | 150/132 |

FOREIGN PATENT DOCUMENTS

| | | | | |
|---|---|---|---|---|
| 580933 | * | 10/1976 | (CH) | 150/112 |
| 479508 | * | 4/1916 | (FR) | 150/132 |
| 566963 | * | 2/1924 | (FR) | 150/132 |
| 1042029 | * | 10/1953 | (FR) | 150/133 |
| 103043 | * | 1/1917 | (GB) | 150/132 |

* cited by examiner

*Primary Examiner*—Sue A. Weaver

(57) ABSTRACT

A wallet for carrying currency. The wallet includes first and second rectangular members having inner and outer faces and adapted to be maintained so that the inner faces are in near abutment. The wallet can be folded along a crease when the inner face of the first rectangular member and a second rectangular member are in near abutment. The wallet includes four straps, two that extend across the inner face of the first rectangular member from the left side of the first rectangular member to the left side of the second rectangular member and two that extend across the face of the inner second rectangular member from the right side of the first rectangular member to the right side of the second rectangular member. The third strap and the fourth do not abut against the first strap when the first rectangular member and a second rectangular member are in near abutment and the first and second straps and the third and fourth straps are adapted to hold a piece of currency against the first rectangular member and the second rectangular member, respectively, when the first rectangular member and the second rectangular member are in near abutment. The shape of the straps allows currency to be held in the wallet without tearing the currency.

3 Claims, 3 Drawing Sheets

MONEY TRAP WALLET

This application claims the benefit of the filing date of applicant's provisional patent application Ser. No. 60/138,265 filed on Jun. 9, 1999.

FIELD OF THE INVENTION

The invention is in the field of a strapping type of wallet, which uses straight and crisscross straps, which place or move the bill or paper money under these straps to contain or hold it when folded correctly, unlike a conventional wallet, which uses a slot for inserting bills.

BACKGROUND OF THE INVENTION

The invention relates to a strapping type of wallet well known in the industry. Examples of strapping wallets and paper bill folders and holders are as follows:

1. McKay patent, U.S. Pat. No. 1,326,602.
2. Sutter patent, U.S. Pat. No. 1,580,346
3. Hughes patent, U.S. Pat. No. 1,833,881.
4. Trussel patent, U.S. Pat. No. 1,973,420.
5. Traugott patent, U.S. Pat No. 4,010,787.

The above mentioned wallets contain paper bills through the use of (a) strap(s) that restrain the center of the bill to one side while folding the ends of the bill through Corresponding straps. Often the bill is torn when it is being contained or enclosed within these straps, especially if the wallet is sized down to fit the paper money it encloses.

In the development of The Money Trap Wallet, the inventor, Mr. Bibb, conducted much study of the Traugott patent and the Sutter patent wallet designs and their practical uses. After hundreds of trails, Mr. Bibb realized several limitations within the design. The main limitation is that the size of the wallet cannot be reduced to the approximate size of the bill or the paper money, because a tearing of the bill would often result. Each effort of patterning a wallet after this patent caused the bill to be torn at the straps. Mr. Bibb noticed that the "X" design caused a stress buckle to occur from the center of the bill to its exterior when the wallet is made small. When no crisscross or "X" format was used for the straps, as in the Hughes patent, the bill would also tear. The Hughes wallet used straight straps, which did not cause the stress buckle, but instead caused the bill to snake through the straps, tearing the bill approximately on inch off center on either end. Also, each of these designs would tear a new bill or paper receipts when enclosing them.

SUMMARY OF THE INVENTION

With consideration of every patented strap wallet, this invention is unique in that when produced almost the size of the bill, which it is to contain, it will not tear the bill. It is not limited as to size or geometric configuration except to the size of the paper money it is to contain. Because bill sizes vary from country to country, the size of the wallet will need to be varied in accordance with the country it is being produced for. Once the user inserts cards or belongings into the compartments, the wallet becomes stiff allowing for superior strap functioning. The inventor, after years of trail and error research, discovered that when the straps hold or pull only the corners of the bill, the wallet's size is no longer limited. Therefore, this wallet can be produced smaller in size making it comfortable to carry and to handle. This wallet is made with most flexible materials such as leather, vinyl, and/or sturdy cloth. The most practical material used is a rubber-based vinyl. Completely closed, contained bills fold along their narrowest center. The straps can hold bills on both or either of the side panes.

BRIEF DESCRIPTION OF THE DRAWINGS

FIGS. 1, 2, 3, and 4 are four simplified versions of strap designs that activate bill containment at the corners. Yet, these are only a few of the possibilities of geometric strap designs using a symmetrical format to contain the bills. Other geometric and amorphous variation can also be applied using the same basic idea for containment of the bill at the corners. This patent is for any wallet formation, symmetrical design or otherwise that contains the bills at the corners.

DETAILED DESCRIPTION OF PRESENT PREFERRED EMBODIMENTS

The wallet consists of a cover panel, four straps, and a coin panel. This combination, altogether, and folded. Make an attractive wallet.

Figure 1:
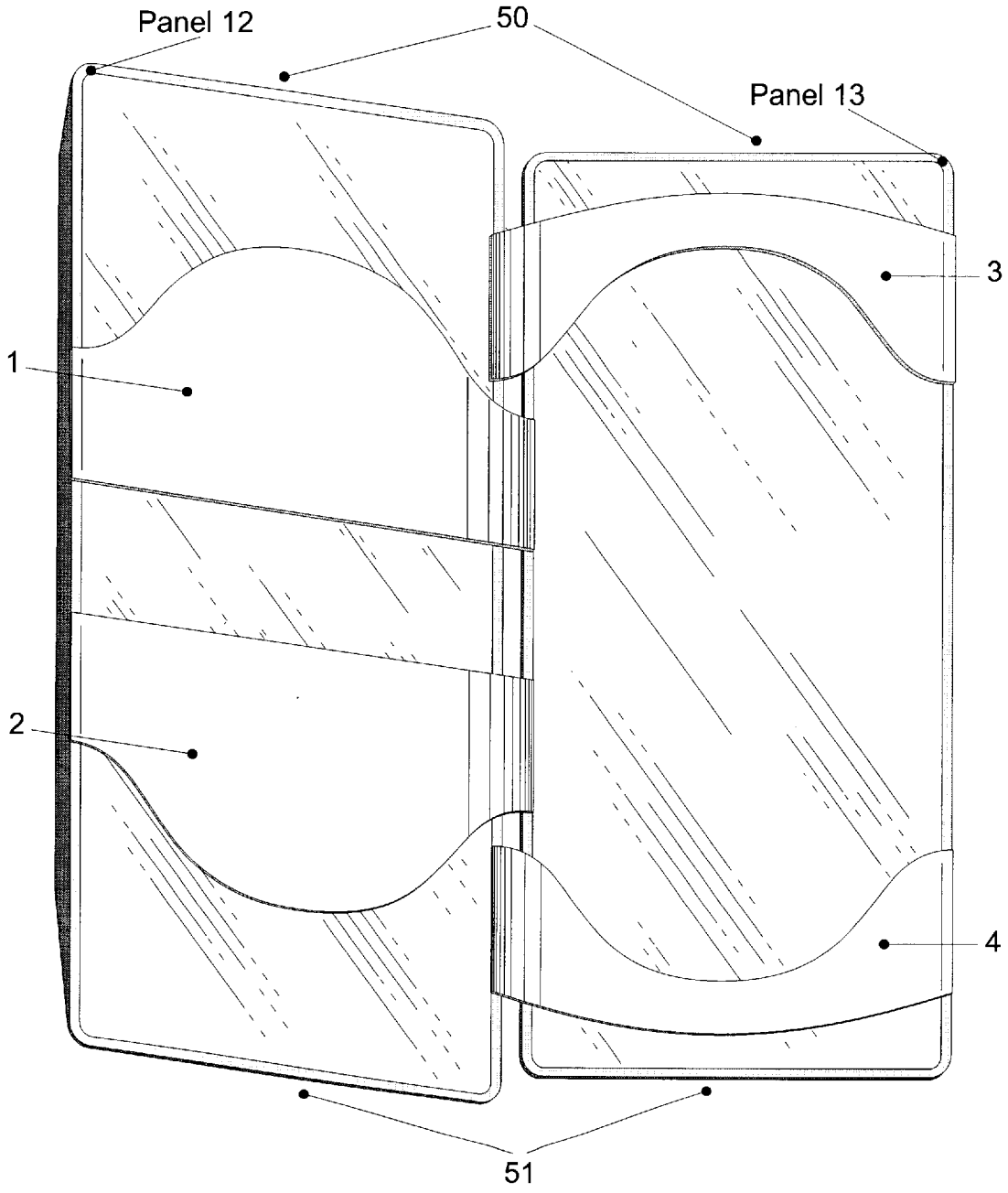
FIG. 1 is the primary drawing showing the wallet with panels opened exposing straps and inside compartments.

Referring to FIG. 1, the two panels of the wallet are open, exposing the straps, compartments, and clear view coin panel. The four straps 1, 2, 3, and 4 attach panels 12 and 13 to each other.

This invention is strictly based on the design and relative location of the straps 1, 2, 3, and 4. These straps simply flip the corners of the bill to contain it within the wallet. Shown in these drawings are only a few of the possibilities of geometric strap designs using a symmetrical format to contain the bills. Other geometric and amorphous variation can also be applied using the same basic idea for containment of the bill at the corners. This patent is for any wallet formation, symmetrical design or otherwise that contains the bills at the corners.

Former strap wallets work by restraining very little of the center or midsection of the bill with its center strap(s) to one side of the wallet while the top and bottom two straps fold the bill almost in half causing it to tree buckle in order to contain it. These early straps cause much resistance on the bill itself while it is being contained because of the stress buckle from the center strap(s). Therefore a tear in the bill will often result.

This invention works by restraining the bill from its midsection (the space between straps 1 and 2) nearly to its ends (50 and 51) with its center straps (1 and 2) which shall be called takers to one of the side panels (12 and 13), while the top (3) and bottom (4) two straps which shall be called guides, guide over only the corner edges and/or the very ends of the bill to contain it. The takers (1 and 2) pull the bill past the guides (3 and 4) with a cycle of first two corners, then two more corners leaving bill contained behind takers (1 and 2). These straps 1, 2, 3, and 4, cause little or no resistance on the bill itself while the bill is being contained. Therefore the design eliminates tearing of the bill.

Simply lay bill flat onto panel 13 or 12 over straps. Close panels 12 and 13 with panel 13 on top. Flip wallet over so the panel 12 is on top. Open slowly from the left side. Note: Takers (1 and 2) drawing bill through guides (3 and 4) first two corners then remaining two corners of bill, retaining bill under takers (1 and 2).

To remove bill from wallet, close panels 12 and 13. Place wallet with panel 13 on top. Insert finger or left thumb into left side between the bill and panel 13. Now open panel 13 while holding bill with thumb. Bill is released. Bill can also be removed by opening panels 12 and 13, grasping bill at top or bottom edge, and simply sliding bill from under the straps.

As seen in FIG. 1, straps 1 and 2 abut on their left edge to cover panel 12 and on their right edge to enter panel 13. While straps 3 and 4 abut on their left edge to cover panel 12 and on their right edge to enter panel 13. This process can be reversed either way, as long as the straps takers 1 and 2 cross over guide straps 3 and 4 to confine the bill within the wallet.

Figure 2:
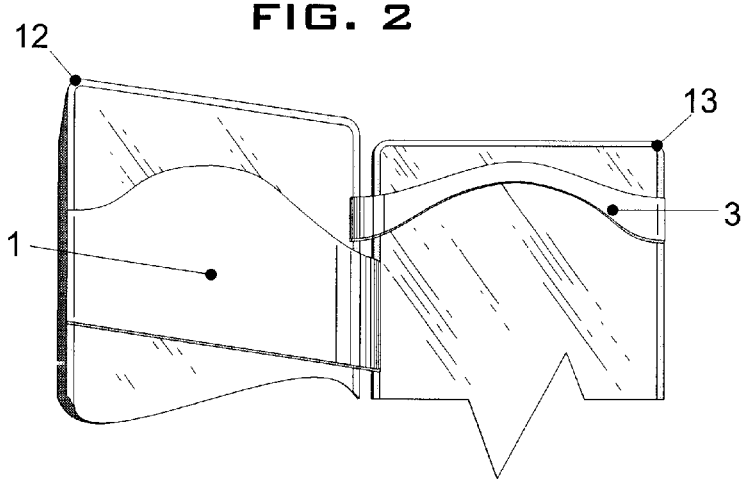
FIG. 2 is a variation of the strap design using a subtle arch, instead of the dramatic arched straps show in FIG. 1.
Figure 3:
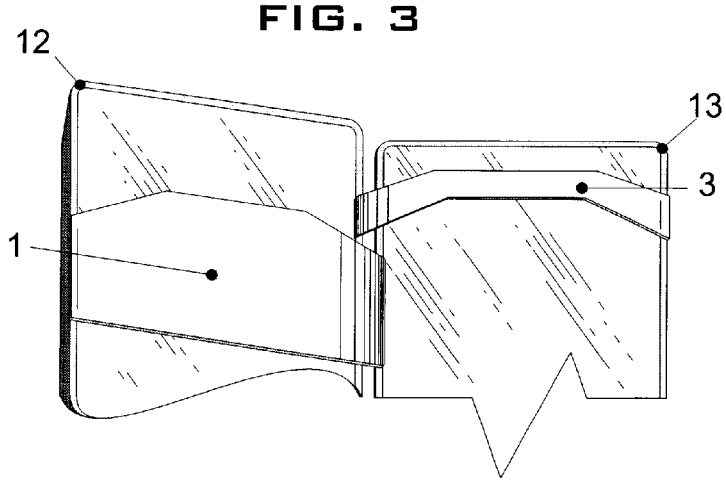
FIG. 3 is another variation of the strap design using a straight edge arch, somewhat like a trapezoid.
Figure 4:
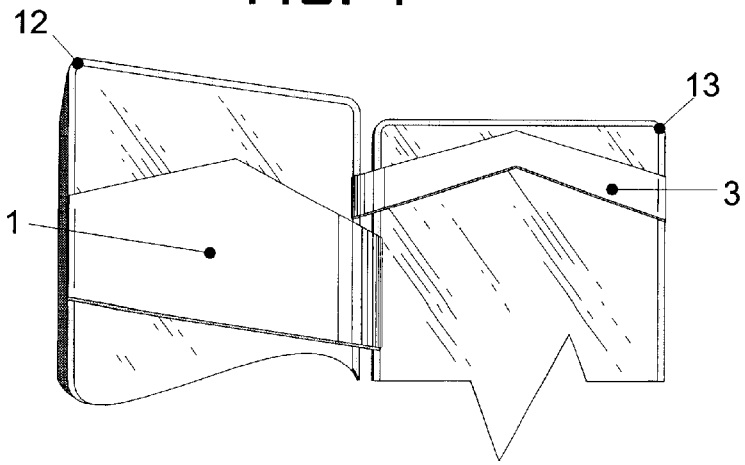
FIG. 4 is a variation of the strap design using a tee-pee or mountain peak shape.
Figure 5:
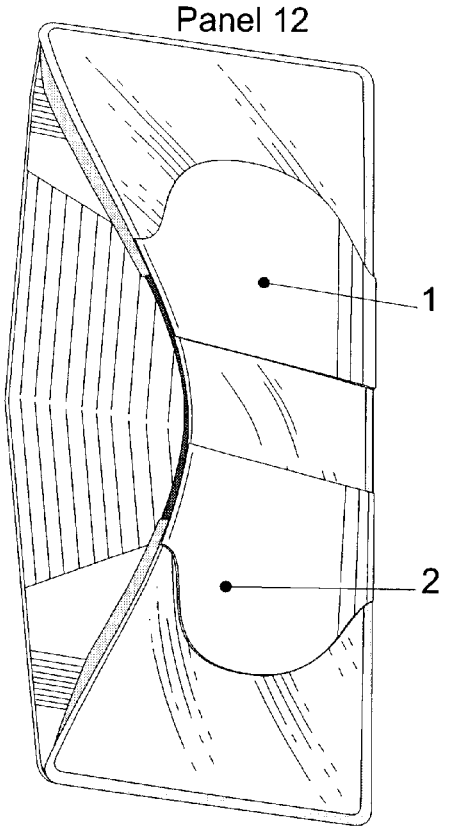
FIG. 5 is the Side Panel Opening, which spans the entire length of the wallet; allowing for more compartments and a separate place for bill sized s well as smaller paper containment.
Figure 6:
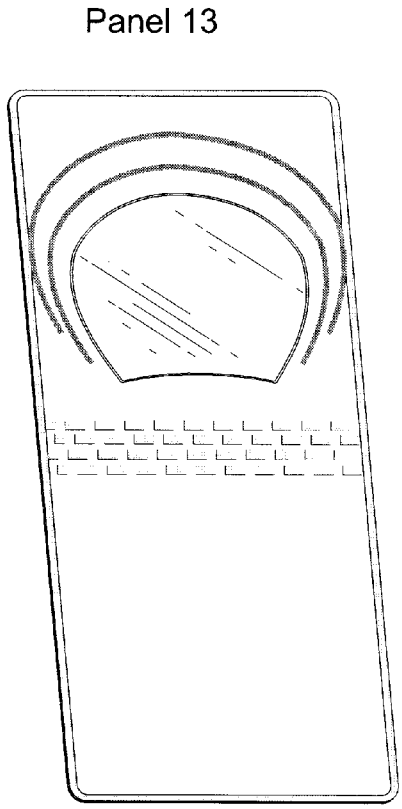
FIG. 6 is the coin panel showing the coin aperture for enclosing the dispersing coins. This compartment with clear panel exposes picture and perforated fold lock.

Referring to FIGS. 2, 3, and 4, different examples of strap design configurations are shown. Each one is capable of the corner and/or end confinement of paper money. Yet these designs are not limited as to size or geometric configuration. These figures demonstrate how subtle changes in the strap designs do not interfere with the overall goal of this invention, which to eliminate paper bill tears known to former strap wallets.

Figure 7:
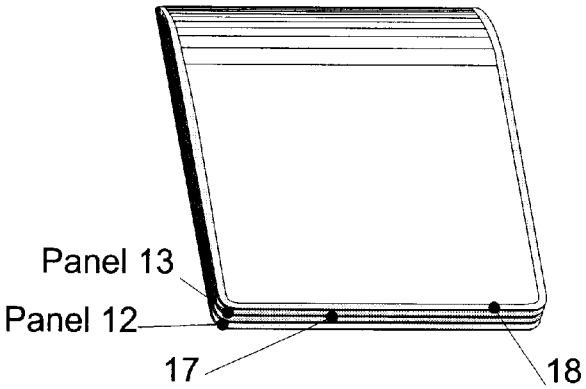
FIG. 7 is a closed wallet.

Referring to FIG. 7, the completely closed wallet is shown. In this closed position, note that the outside edges 17 and 18 are even. Enter panel 13's length is slightly less than cover panel 12. Therefore, the closed wallet has a cleaner appearance. To remove a bill while the wallet is completely closed, simply lift edge 18 of the cover panel 12 and slide bill out.

What is claimed is:

1. A wallet for carrying currency comprising:

a first planar rectangular member and a second planar rectangular member, wherein each rectangular member has a left side and a right side having a length, a top side and a bottom side having a width, a crease that extends from the left side to the right side midway between the top side and the bottom side, and an inner and an outer face, wherein the length is relatively larger than the width and the length and width are slightly larger than a length and width of a piece of currency, wherein the first planar rectangular member and the second planar rectangular member are adapted such that the inner face of the first planar rectangular member and the inner face of the second planar rectangular member are maintained in near abutment and wherein the first planar rectangular member and a second planar rectangular member can be folded along the crease when the inner face of the first planar rectangular member and a second planar rectangular member are in near abutment;

a first strap, that extends across the inner face of the first planar rectangular member from the left side of the firs planar rectangular member to the left side of the second planar rectangular member, wherein the first strap is positioned between the crease and the bottom side of the first planar rectangular member and closer to the crease and has an edge closest to the bottom side of the first planar rectangular member that projects toward the bottom side of the first planar rectangular member;

a second strap, that extends across the inner face of the first planar rectangular member from the left side of the first planar rectangular member to the left side of the second planar rectangular member, wherein the second strap is positioned between the crease and the top side of the first planar rectangular member and closer to the crease and has an edge closes to the top side of the first planar rectangular member that projects toward the top side of the first planar rectangular member;

a third strap that extends across the inner face of the second planar rectangular member from the right side of the second planar rectangular member to the right side of the first planar rectangular member, wherein the third strap is positioned between the crease and the bottom side of the second planar rectangular member and closer to the bottom side of the second planar rectangular member and wherein the third strap projects toward the bottom side of the of the second planar rectangular member; and a fourth strap that extends across the inner face of the second planar rectangular member from the right side of the second planar member to the right side of the first planar rectangular member, wherein the fourth strap is positioned between the crease and the top side of the second planar rectangular member and closer to the top side of the second planar rectangular member and wherein the fourth strap projects toward the top side of the of the second planar rectangular member;

wherein the third strap and the fourth do not abut against the first strap and the second strap when the first planar rectangular member and a second planar rectangular member are in near abutment and wherein the first and second straps and the third and fourth straps are adapted to hold a piece of currency against the first planar rectangular member and the second planar rectangular member, respectively, when the first planar rectangular member and a second planar rectangular member are in near abutment.

2. The wallet of claim 1, wherein the edge of the first strap and the edge of the second strap have a substantially concave shape and the third and fourth strap have a substantially concave shape.

3. The wallet of claim 1, wherein the edge of the first strap and the edge of the second strap have a substantially triangular shape and the third and fourth strap have a substantially triangular shape.

* * * * *